United States Patent [19]

Imamura et al.

[11] Patent Number: 4,665,341

[45] Date of Patent: May 12, 1987

[54] COLORED FLUORESCENT LAMP ASSEMBLY

[75] Inventors: Hiroshi Imamura, Hirakata; Katsumasa Nakai; Masahiro Higashigawa, both of Kadoma; Makoto Toho, Yahata, all of Japan

[73] Assignee: Matsushita Electric Works, Ltd., Osaka, Japan

[21] Appl. No.: 756,452

[22] Filed: Jul. 18, 1985

[30] Foreign Application Priority Data

Dec. 3, 1984 [JP] Japan ..... 59-255461

[51] Int. Cl.[4] ..... H01J 61/35

[52] U.S. Cl. ..... 313/493; 313/610

[58] Field of Search ..... 313/493, 610

[56] References Cited

U.S. PATENT DOCUMENTS

| | | | |
|---|---|---|---|
| 2,102,190 | 12/1937 | Barclay | 313/610 X |
| 2,121,333 | 6/1938 | Barclay | 313/610 X |
| 2,265,323 | 12/1941 | Spanner . | |
| 4,199,708 | 4/1980 | Lauwerijssen et al. | 313/493 |
| 4,208,618 | 6/1980 | Heine | 313/493 X |
| 4,272,703 | 6/1981 | Eckberg | 313/493 X |
| 4,587,462 | 5/1986 | Buhrer | 313/493 X |

*Primary Examiner*—Palmer C. DeMeo

*Attorney, Agent, or Firm*—Burns, Doane, Swecker & Mathis

[57] ABSTRACT

A colored fluorescent lamp assembly wherein a plurality of lamp tubes each coated on the inner surface with each of different coloring fluorescent substances and gas-tightly closed at one end having an electrode communicate their interior at the other open end with the interior of a gas-tight cell having a common electrode, and a single lighting control means controllably causes discharge lightings between the common electrode and the respective electrodes in the lamp tubes, for variably colored light emissions with a compact outline.

15 Claims, 23 Drawing Figures

(b)

(a)

Fig. 18
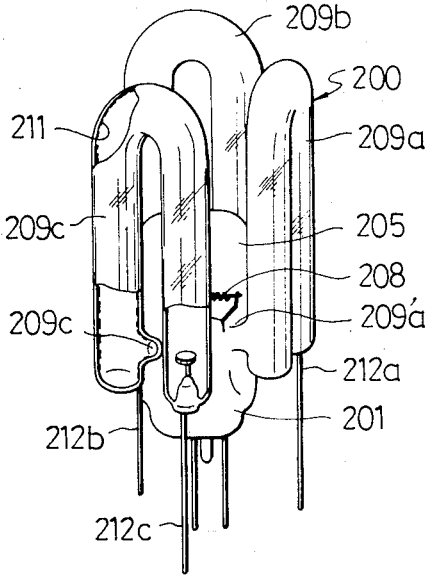
Fig. 19
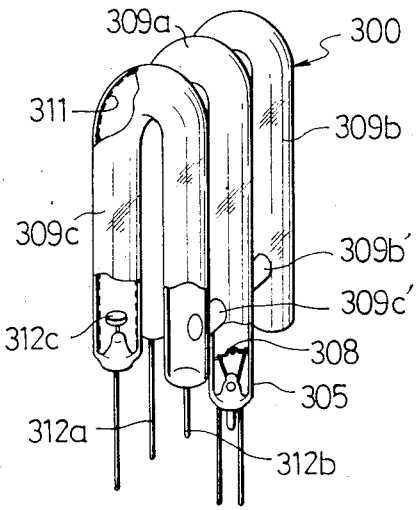
Fig. 20 (a)
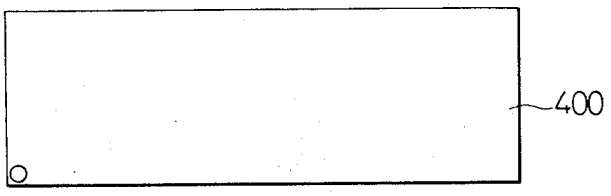
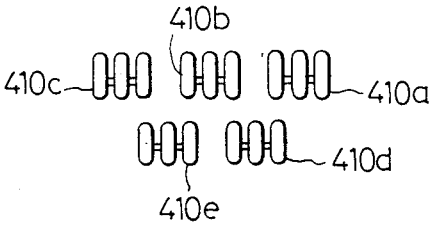
Fig. 20 (b)

COLORED FLUORESCENT LAMP ASSEMBLY

TECHNICAL BACKGROUND OF THE INVENTION

This invention relates to colored fluorescent lamp assemblies and, more particularly, to a fluorescent lamp assembly of which a plurality of fluorescent lamps luminous in different colors can emit a light of freely variable color.

Such colored fluorescent lamp assembly can be applied to, for example, variable color lightings or luminous display devices to effectively realize a fully variable color illumination or display.

DISCLOSURE OF PRIOR ART

A colored fluorescent lamp assembly of the kind referred to has been disclosed in U.S. Pat. No. 4,199,708 to Petrus C. Lauwerijssen et al, a fluorescent lamp in an embodiment of which comprises a base plate positioned on a lamp base and provided with a pair of negative and positive electrodes, a U-shaped lamp tube having longer and shorter leg portions and supported at the longer leg portion on the base plate in cantilever form to enclose therein the positive electrode, and a dome-shaped outer envelope fixed to the base plate to limit a gas-tight space around the lamp tube and the negative electrode. In this arrangement, the shorter leg portion of the lamp tube is opened in the gas-tight space as separated from the base plate so that the lamp tube interior communicates with the gas-tight space in the envelope, and the lamp tube interior and gas-tight space are filled with a discharge gas to be able to act as a discharge space in their entirety, in which a proper discharge lighting can be performed between the positive electrode in the lamp tube and the negative electrode in the envelope. Further, this fluorescent lamp may be modified in view of another U.S. Pat. No. 2,265,323 to H. J. Spanner showing a discharge tube having at its one end a single negative electrode and at the other branched ends a plurality of positive electrodes, so that the single negative electrode can be used in common to the plurality of positive electrodes respectively enclosed in one end of each of a plurality of the lamp tubes within the gas-tight space of the envelope, for a controllable lighting with a single control means of a proper discharge between the common negative electrode and the plurality of positive electrodes.

In the variable color lighting fluorescent lamp devices, generally, there has been a problem that a light adjustment stabilizer for the light control means must be used together with a current limiting choke, electrode preheating circuit, phase control circuit for light adjustment and the like, unlike a stabilizer used for ordinary white fluorescent lamps, so that the known lighting control means required to have each of control circuits provided with respect to each of the colored lamp tubes must be increased in size and made complicated in circuit arrangement. According to the above U.S. patents, it may be possible to eliminate this problem.

In the case of the arrangement based on these U.S. patents, it is an advantage that only a single light control means suffice the purpose, but it is considered that problems in many respects should arise in realizing this arrangement. More particularly, in the above U.S. Pat. No. 4,199,708, the utilization of the whole interior of the envelope as the discharge space has made it possible to render the negative electrode to be single, but a disadvantage exists in practice in that the discharge space is unnecessarily increased in size of the lamp assembly, because it is required for the colored lighting to render only the lamp tube interior coated with a coloring fluorescent substance to be contributive to the lighting. While it is generally required, further, to effectively prevent any foreign matter from being admitted into the discharge space to avoid its adverse affect on the discharging operation, the structure based on the foregoing U.S. patents, involves an apparent problem that, as compared with the case where the admission preventive measure is called for only with respect to the lamp tube interior, the preventive measure is necessitated not only for the lamp tube but also for the considerably larger space in the envelope, and the manufacture must be performed under a highly precise administration. Further, such double structure as in the U.S. Pat. No. 4,199,708 of inner lamp tube and outer envelope causes another problem to arise in raising normally generated high temperature within the lamp tubes to a level beyond a desired limit temperature, due to a heat insulation of the outer envelope surrounding the lamp tubes, whereby normally caused deterioration of the fluorescent substance on the inner surface of the lamp tubes is accelerated to quickly lower the chroma of the emitted colored light.

In the U.S. Pat. No. 4,199,708, further, the cantilevered support at the longer leg portions of the lamp tubes with respect to the base plate within the gas-tight envelope makes it difficult to achieve a sufficiently high holding strength for the lamp tubes, so that there arises a risk that any vibratory motion given to the fluorescent lamp assembly during its transportation or the like may result in an easy disconnection of the tubes from the base plate for disabling the assembly. In addition, the gas-tight joining work between the base plate and a relatively large opening edge of the dome-shaped envelope requires a high level technique and installation therefor, and the yield of production is caused to be lowered.

TECHNICAL FIELD OF THE INVENTION

A primary object of the present invention is, therefore, to provide a colored fluorescent lamp assembly capable of freely varying the color of emitted light of a plurality of lamp tubes respectively having on their inner surface a coating of mutually different coloring fluorescent substance, while maintaining advantages in minimizing one of a pair or pairs of electrodes, in particular, negative electrode as well as required lighting control means to be single, and of unnecessitating any outer envelope so as to minimize the size of the lamp assembly and extent of required administration for preventing admittance of foreign matters into the discharge space inside the lamp tubes, to restrain inherent deterioration of the coloring fluorescent substance with eliminated undue temperature rise, and to prevent the lamp tubes from being readily disconnected for improving the yield of production.

According to the present invention, this object can be realized by providing a colored fluorescent lamp assembly for variably colored light emission comprising a plurality of lamp tubes filled with a discharge gas and respectively coated on the inner surface with each of different coloring fluorescent substances, the lamp tubes respectively being closed gas-tightly at least at one end which having one of opposing discharging electrodes, a gas-tightly sealed space having the other one of the discharging electrodes to act as a common electrode, the lamp tubes communicating their interior with the sealed space respectively at the other end, and a single lighting control means for causing lighting discharges between the common electrode and the electrodes provided at the respective closed ends of the lamp tubes, wherein the gas-tightly sealed space having the common electrode comprises a cell disposed in proximity to the other ends of the lamp tubes and dimensioned to be smaller in the axial direction of the lamp tubes than their axial length.

Other objects and advantages of the present invention shall become clear from the following description of the invention detailed with reference to preferred embodiments illustrated in accompanying drawings.

BRIEF EXPLANATION OF THE DRAWINGS

FIG. 7(*b*) is a top plan view of the assembly of FIG. 7(*a*);

FIGS. 18 and 19 are perspective views of lamp assemblies according to still further embodiments of the present invention employing U-shaped lamp tubes;

FIG. 20(*a*) is a front view of a rectangular color display to which the colored fluorescent lamp assembly of the present invention is applied; and FIG. 20(*b*) is a schematic diagram for showing an example of arrangement of lamp assemblies housed within the color display of FIG. 20(*a*).

Figure 4:
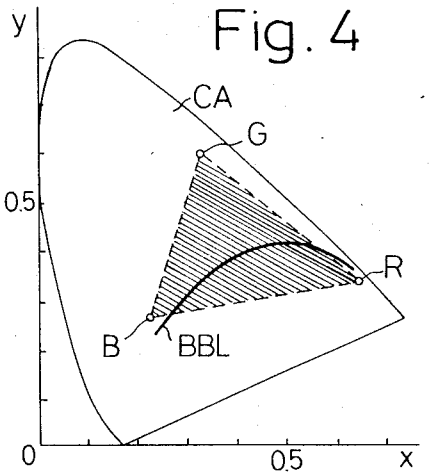
FIG. 4 is a chromaticity diagram for explaining a state in which a variably mixed color of light is obtained by the lamp assembly of FIG. 1.

While the present invention shall now be described with reference to the preferred embodiments shown in the drawings, it should be understood that the intention is not to limit the invention only to the particular embodiments shown but rather to cover all alterations, modifications and equivalent arrangements possible within the scope of appended claims.

DISCLOSURE OF PREFERRED EMBODIMENTS

Figure 1:
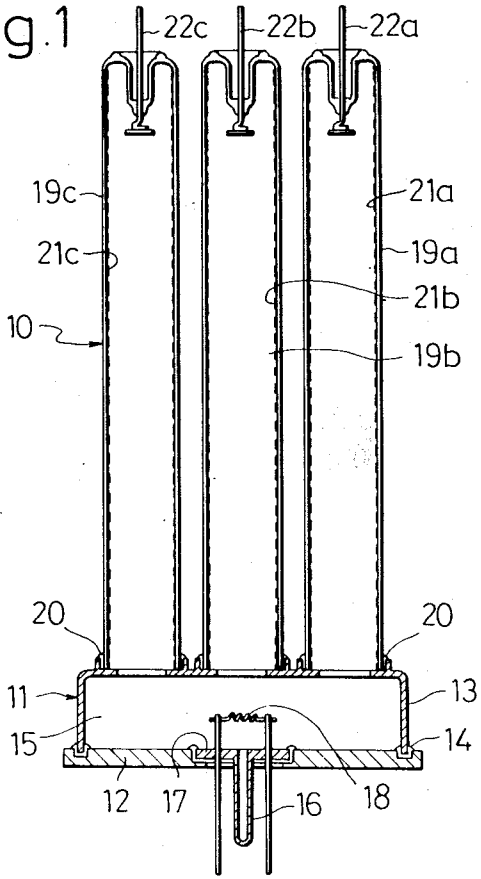
FIG. 1 is a vertically sectioned view of a colored fluorescent lamp assembly according to an embodiment of the present invention which uses linear lamp tubes.

Referring to FIG. 1, there is shown a colored fluorescent lamp 10 which includes a lamp base 11 comprising a rectangular stem plate 12 and a box-shaped base body 13 open at its bottom, the stem plate 12 and base body 13 being made respectively of such a material as a ceramic, glass or metal, or particularly preferably a forsterite ceramic. The open bottom end of the base body 13 is seated on the stem plate 12 and gas-tightly secured thereto through a glass frit 14 to define a cell 15 together with the stem plate 12, the latter of which is provided at its center with a button stem 17 having an exhaust pipe 16 projecting downwardly outward and a common electrode 18 erected upwardly inward to be operable as a negative electrode, and the cell 15 thus forms a common electrode chamber.

The base body 13 is formed to have in its top plate three mutually spaced openings, and three lamp tubes 19*a*, 19*b* and 19*c* are respectively secured at their open end to the top plate through glass frit 20 so as to enclose each of the openings and communicate their interior with that of the cell 15. The lamp tubes 19*a*, 19*b* and 19*c* are coated on their inner surface respectively with each of different fluorescent substances 21*a*, 21*b* and 21*c* emitting differently colored lights. It is preferable that the fluorescent substances 21*a*, 21*b* and 21*c* are of red, green and blue systems, respectively, specifically such as YOX ($Y_2O_3$:Eu), CAT ($MgAl_{11}O_{19}$:Ce,Tb) and BAM ($BaMg_2Al_{16}O_{27}$:Eu), respectively. Further, the lamp tubes 19*a*, 19*b* and 19*c* are closed at the top ends as by being melted by means of a burner to gas-tightly hold respectively each of electrodes 22*a*, 22*b* and 22*c* which forming three positive electrodes.

Figure 2:
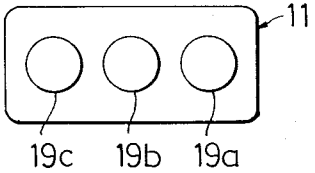
FIG. 2 is a schematic top plan view showing an example of arrangement of the lamp tubes in FIG. 1.

With the above arrangement, the three lamp tubes 19*a*, 19*b* and 19*c* extend vertically in parallel from the lamp base 11 as seen in FIGS. 1 and 2 and are carrying at their closed ends the three positive electrodes 22*a*, 22*b* and 22*c* opposed to the common negative electrode 18 in the cell 15 through their interior spaces communicating with each other and filled with a discharging gas. When a voltage is applied between sequentially selective ones of the electrodes 22*a*, 22*b* and 22*c* and the common electrode 18, the lamps can perform the discharge lightings in a predetermined sequence while freely varying the color of emitted light, even with the single negative electrode 18 used commonly. This enables it possible to cause selectively the discharge lighting to take place between the common electrode 18 and any one of the electrodes 22*a* to 22*c* in the lamp tubes 19*a* to 19*c* by means of a single lighting control means, to realize the variably colored light emission.

Figure 3:
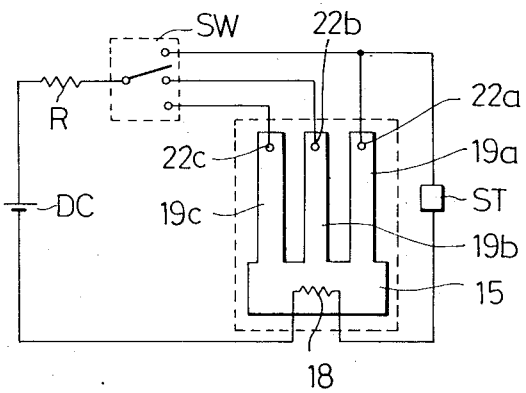
FIG. 3 is a circuit diagram of a lighting control means for the lamp assembly of FIG. 1.

Referring to FIG. 3, a single lighting control circuit in one aspect for use in the present invention includes a selective change-over switch SW connected through a ballast resistor R to a positive terminal of a D.C. power source DC, and the electrodes 22*a* to 22*c* of the lamp tubes 19*a* to 19*c* are connected to the switch SW for their selective connection to the source DC which is also connected at its negative terminal to an end of the common electrode 18, while a starter ST is connected between the other non-source side end of the common electrode 18 and one of the electrodes 22*a* to 22*c* of the lamp Lubes, for example, the electrode 22*a*. Preferably, the change-over switch SW should comprise switching transistors rendering the duty ratio to be variable so that respective discharge paths of the lamp tubes 19*a* to 19*c* will be subjected to change-over operations of distributed duties according to operational cycles of the switching transistors.

When, in the lighting control circuit of FIG. 3, the electrode 22*a* of the lamp tube 19*a* is connected through the change-over switch SW to the positive terminal of the D.C. power source DC, the common electrode 18 is heated through the starter ST and a high voltage pulse is applied between the electrode 22*a* and the common electrode 18, so that a discharge path will be formed within the lamp tube 19*a* and cell 15 and a red light will be emitted. When the electrodes 22*b* and 22*c* of the lamp tubes 19*b* and 19*c* are sequentially connected next, through the switch SW to the positive terminal of the source DC, discharge paths of green and blue lights are sequentially formed between each of the electrodes 22*b* and 22*c* and the common electrode 18 which is kept in the thermionic emission state as having been heated by the previous discharging between the electrodes 18 and 22*a*, thus without requiring the starter. When such operation is continuously performed at a high rate through the selective change-over switch SW, viewers will recognize that variously colored lights are continuously emitted. Therefore, a properly set duty ratio of the change-over switch SW for the discharge paths through the lamp tubes 19*a* to 19*c* will enable it possible to obtain an optimum chromaticity within a hatched zone defined by lines connecting between points R, G and B and lying in a chromaticity range CA as shown in FIG. 4, so that the chromaticity can be varied following, for example, such a locus as shown by a curve BBL in the drawing.

Figure 5:
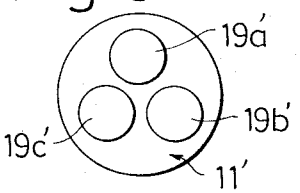
FIG. 5 is a schematic top plan view showing another example of arrangement of the lamp tubes in FIG. 1.

While the three lamp tubes 19*a*, 19*b* and 19*c* have been arranged linearly as shown in FIG. 2 in the above embodiment, the lamp tubes may be arranged so that, as shown in FIG. 5, lines connecting the centers of lamp tubes 19*a*', 19*b*' and 19*c*' will form a triangle on a lamp base 11' which is made circular here. It will be appreciated in any arrangements that the gas-tight cell 15 forming the common electrode chamber and located at the bottom of the lamp tubes should be dimensioned to be much smaller in the axial direction of the lamp tubes than the axial length of the tubes.

Figure 6:
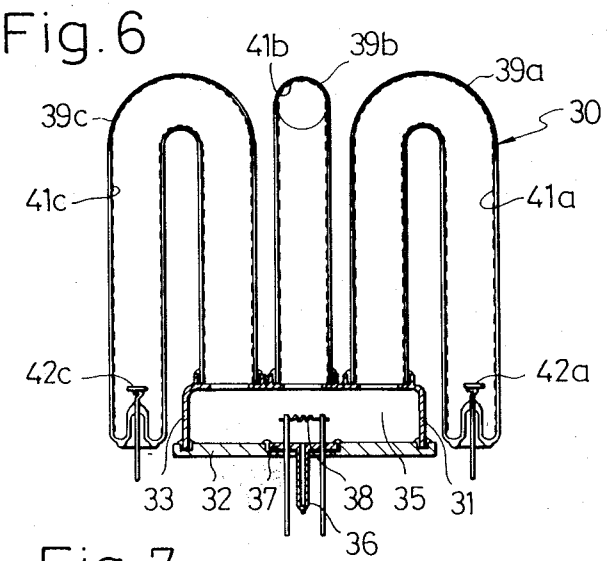
FIG. 6 is a vertically sectioned view of a colored fluorescent lamp assembly according to another embodiment of the present invention which uses U-shaped lamp tubes.
Figure 7:
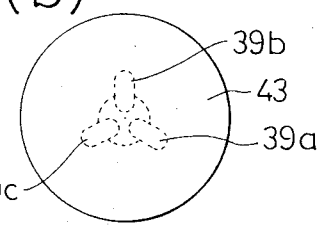
FIG. 7(*a*) is a side view showing a state in which the lamp assembly of FIG. 6 is housed within a globe.
Figure 7:
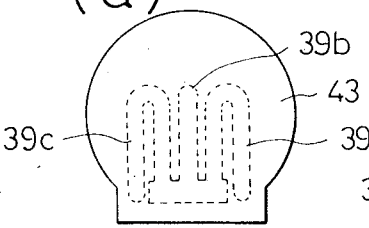

Referring next to FIGS. 6 and 7, there is shown a fluorescent lamp assembly 30 according to another embodiment of the present invention, wherein substantially the same constituent members as those in FIGS. 1 and 2 are denoted by the same reference numerals but added by 20. The arrangement of the present embodiment is substantially the same as that of the foregoing embodiment except that U-shaped lamp tubes 39*a*, 39*b* and 39*c* are used in place of the linear lamp tubes. In this case, the U-shaped lamp tubes 39*a* to 39*c* allow the lamp assembly 30 to be housed within a spherical light-diffusing globe 43 as shown in FIGS. 7(*a*) and 7(*b*), so as to be a ball-shaped lamp. Further, in this embodiment, bent leg portions of the lamp tubes 39*a* to 39*c* are made to be different in their length, and their closed ends of longer leg portions are preferably extended to the same level as a stem plate 32 as shown in FIG. 6 so as to position electrodes 42*a*, 42*b* and 42*c* at the closed ends of the tubes on the same side of a gas-tight cell 38, so that the fluorescent lamp assembly 30 can be easily subjected to connection wiring to the lighting control means. If necessary, the lamp tubes 39*a* to 39*c* supported at their one ends to a lamp base 31 in cantilever form can be also supported at their closed ends located at the same level as the stem plate 32, so as to strengthen their supporting force. Further, the closed ends of the lamp tubes 39*a* to 39*c* are caused to be positioned radially outside the lamp base 31, so that the gas-tight cell 35 of the lamp base 31 having a smaller size in the axial direction of the tubes than their axial length can be housed compactly within an outline of the whole lamp tubes 39*a* to 39*c*. Other arrangement and operation are substantially the same as those of the foregoing embodiments.

Figure 8:
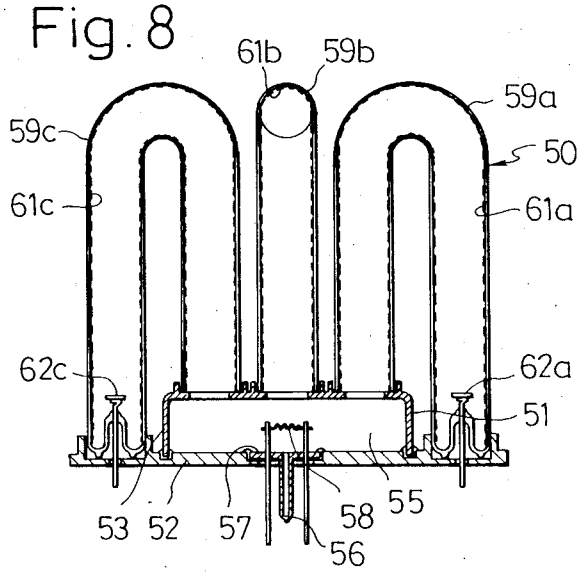
FIG. 8 is a vertically section view of a lamp assembly in a further embodiment of the present invention employing U-shaped lamp tubes.
Figure 9:
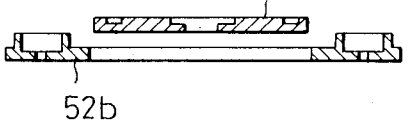
FIG. 9 is a sectioned view as disassembled of a stem plate used in the lamp assembly of FIG. 8 but in a modified form.

Referring to FIG. 8 showing a fluorescent lamp assembly 50 according to a further embodiment of the present invention, the same constituent members as those in FIGS. 6 and 7 are denoted by the same reference numerals but added by 20. In the present embodiment, the closed ends of U-shaped lamp tubes 59*a*, 59*b* and 59*c* disposed in similar manner to the case of FIG. 6 are held not by a separate supporting member but by a radially extended stem plate 52 of a lamp base 51, so as to increase supporting force for the lamp tubes 59*a* to 59*c* and, additionally, to be able to achieve an effective heat transmission from the common electrode side to the tube end electrode side. For the latter purpose, the stem plate 52 is preferably made of such metal as copper or iron which is higher in the thermal conductivity than air, for a better transmission of heat generated at the common electrode 58 to the electrodes 62*a* to 62*c* at the closed ends of the lamp tubes, whereby any deterioration in the emitted light intensity due to a drop of the mercury ion density on the side of the electrodes at the closed ends of the lamp tubes upon the DC voltage application, that is, a dark-end effect can be effectively prevented. In this connection, the stem plate 52 may be formed, as shown in FIG. 9, as divided into a first section 52*a* to be secured to a base body 53 and a second section 52*b* supporting only the closed ends of the lamp tubes 59*a* to 59*c*, and the first and second sections 52*a* and 52*b* are joined integrally. Other arrangement and operation are substantially the same as those of the foregoing embodiments.

Figure 10:
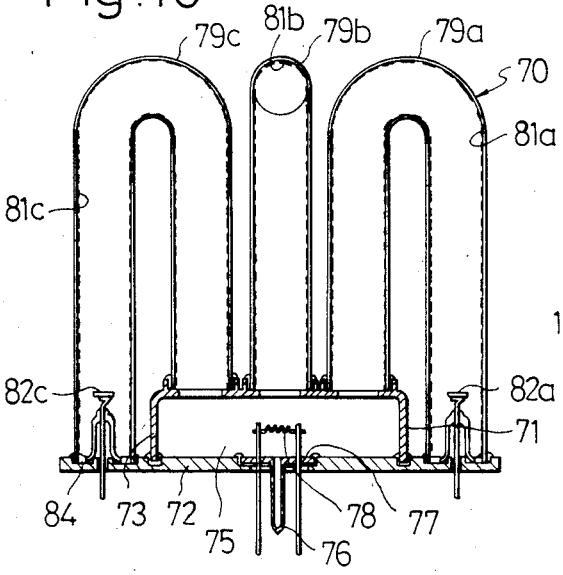
FIGS. 10 to 12 are vertically sectioned views of lamp assemblies according to other different embodiments of the present invention employing U-shaped lamp tubes.

Shown in FIG. 10 is a fluorescent lamp assembly 70 according to a still further embodiment of the present invention, in which the same constituent members as those of the embodiment of FIGS. 8 and 9 are denoted by the same reference numerals but added by 20. In the present embodiment, the electrode-carrying ends of the U-shaped lamp tubes closed as melted in the foregoing embodiments are left open and are gas-tightly secured onto a stem plate 72 through glass frit 84, so as to increase the supporting force for U-shaped lamp tubes 79*a*, 79*b* and 79*c*, while electrodes 82*a* to 82*c* are gas-tightly secured to the plate 72 to be enclosed in the thus secured open ends of the tubes. Other arrangement and operation are substantially the same as those of the foregoing embodiments.

Figure 11:
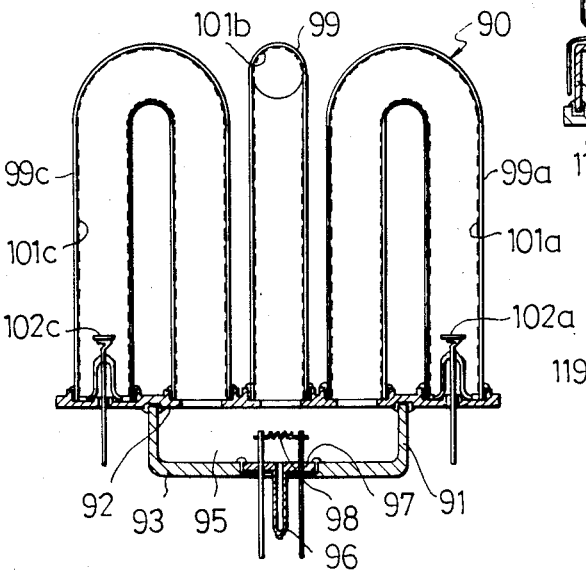

FIG. 11 shows a fluorescent lamp assembly 90 according to yet another embodiment of the present invention, in which the same constituent members as those of the embodiment of FIG. 10 are denoted by the same reference numerals but added by 20. In the present embodiment, the bent legs of U-shaped lamp tubes 99*a*, 99*b* and 99*c* are made to have the same length, in contrast to the lamp tubes of different leg lengths as in the embodiments of FIGS. 6 to 10, both open ends of these lamp tubes 99*a* to 99*c* as well as electrodes 102*a*, 102*b* and 102*c* are respectively secured gas-tightly onto a stem plate 92 through glass frits in similar manner to FIG. 10 but on the same level. On the other hand, a base body 93 is adhered gas-tightly to the bottom surface of the stem plate 92 to define a gas-tight cell 95 having therein a common electrode 98. With such arrangement, the lamp tubes of the same leg length allow their manufacturing as well as their assembling to the stem plate 92 to be easier. Other arrangement and operation are substantially the same as those of the foregoing embodiments.

Figure 12:
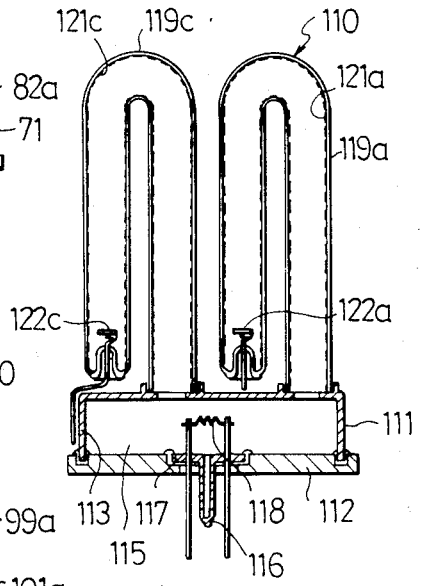
Figure 13:
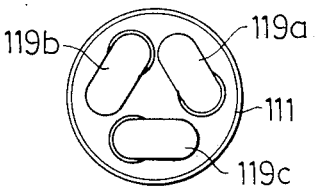
FIG. 13 is a top plan view of the lamp assembly of FIG. 12.

Referring to FIGS. 12 and 13, there is shown a fluorescent lamp assembly 110 according to still another embodiment of the present invention, in which the same constituent members as those of the embodiment of FIG. 11 are denoted by the same reference numerals but added by 20. In the present embodiment, U-shaped lamp tubes 119*a*, 119*b* and 119*c* are made to have bent leg portions substantially of the same length, their one ends closed to carry gas-tightly elecrodes 122*a* to 122*c* are placed substantially on a base body 113 without being secured thereto, while the other open ends are gas-tightly secured to the body 113 for the communication with a gas-tight cell 115, and all of the tube ends are disposed on an imaginary circle on the base body 113. When this fluorescent lamp assembly 110 is housed within a spherical light-diffusing globe, therefore, the three lamp tubes can dispose all of their six leg portions substantially at the same distance from the inner surface of the globe, so that any irregularity in the color of emitted light occurring in the event where the distance is uneven can be prevented, and color mixing property of the assembly can be improved. Other arrangement and operation are substantially the same as those of the foregoing embodiments.

Figure 14:
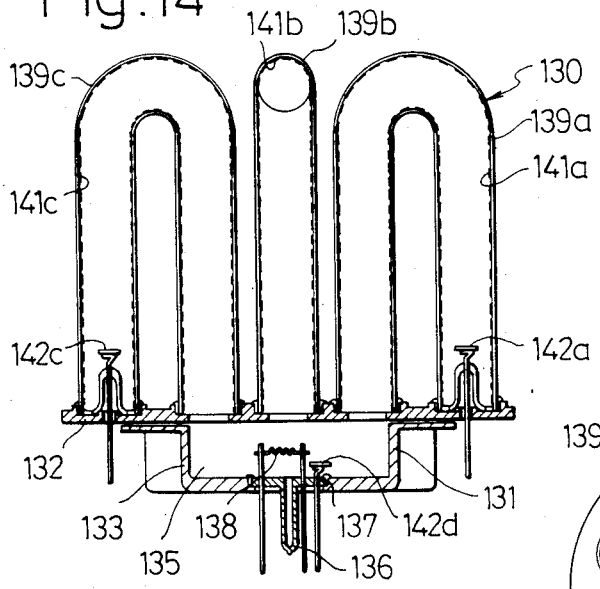
FIG. 14 is a vertically sectioned view of a lamp assembly according to still another embodiment of the present invention also employing U-shaped lamp tubes.
Figure 15:
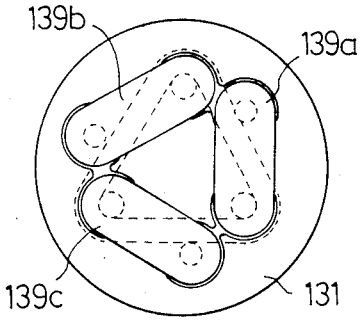
FIG. 15 is a top plan view of the lamp assembly of FIG. 14.

Shown in FIGS. 14 and 15 is a fluorescent lamp assembly 130 according to still another embodiment of the present invention, in which the same constituent members as those of the embodiment of FIGS. 12 and 13 are denoted by the same reference numerals but added by 20. In the present embodiment, similarly to the embodiment of FIG. 11, a base body 133 gas-tightly secured to the bottom surface of a stem plate 132 is formed in such a triangular shape as shown by dotted lines in FIG. 15, so that the volume of gas-tight cell 135 can be further reduced and the size of the fluorescent lamp assembly 130 can be effectively minimized. Along with a common electrode 138, the cell 135 is provided with an auxiliary electrode 142*d* of the same polarity as electrodes 142*a* to 142*c* at closed ends of U-shaped lamp tubes 139*a* to 139*c*, i.e., of the positive polarity, so that a starter may be inserted between the auxiliary electrode 142*d* and the common electrode 138 for rendering the lighting of the lamp assembly to be readily startable even when the discharge path between the electrodes at the closed ends of the lamp tubes and the common electrode is long. When, further, the duty ratio in the discharge path at the cell 135 is made variable by means of such change-over switch SW as in FIG. 3, the cell 135 having no fluorescent substance can be used as an additional discharge path having no coloring function but having a light regulating function. In this embodiment, it is also preferable that the six leg portions of three U-shaped lamp tubes 139*a*, 139*b* and 139*c* are arranged to lie substantially on an imaginary circle as in the embodiment of FIGS. 12 and 13. Other arrangement and operation are substantially the same as those of the foregoing embodiments.

Figure 16:
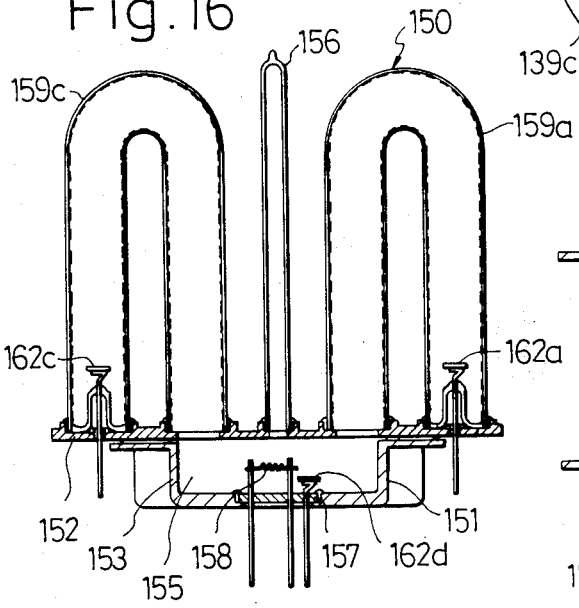
FIG. 16 is a vertically sectioned view of a lamp assembly according to yet another embodiment of the present invention employing U-shaped lamp tubes.

FIG. 16 shows a fluorescent lamp assembly 150 according to still another embodiment of the present invention, in which the same constituent members as those of the embodiment of FIGS. 14 and 15 are denoted by the same reference numerals but added by 20. In the present instance, an exhaust pipe 156 is erected not on the lower side of a lamp base 153 but on the upper side, that is, on the same side of a stem plate 152 as lamp tubes 159*a*, 159*b* and 159*c*. With such arrangement, the length of the exhaust pipe can be made larger without increasing overall height of the fluorescent lamp assembly 150, mounting work for the exhaust pipe can be made much easier than in the case where the exhaust pipe is erected on the stem plate through the bottom stem or on the base body, and exhaust operation can be simplified. Other arrangement and operation are substantially the same as those of the foregoing embodiments.

Figure 17A:
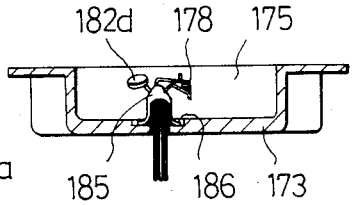
FIGS. 17(*a*) to 17(*b*) are sectioned views respectively showing a sealed cell member used in each of FIGS. 14 and 16.
Figure 17B:
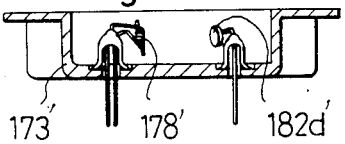

In the arrangement of FIGS. 14 and 15 or FIG. 16 where the axuiliary electrode is provided along with the common electrode, they may be provided conveniently in such that, as shown, for example, in FIG. 17(*a*), a common electrode 178 and auxiliary electrode 182*d* are secured jointly to a base body 173 by means of a common pinch stem 185 through a glass frit 186. If these electrodes are required to be separated from each other, as shown in FIG. 17(*b*), a common electrode 178' and auxiliary electrode 182*d'* may be secured independently to a base body 173' with separate pinch stems. When the common and auxiliary electrodes are bowingly bent as shown in FIGS. 17(*a*) and (*b*), the height of the gas-tight cell which has a trianglar horizontal section can be reduced.

FIG. 18 shows a fluorescent lamp assembly 200 according to still another embodiment of the present invention, which is modified in the style while embodying the same technical features as in the respective embodiments referred to. That is, the lamp assembly 200 comprises a central lamp base 201 which is formed in a barrel shape with a glass material to define therein a cell 205 having a common electrode 208 in the gas-tight manner, and U-shaped lamp tubes 209*a*, 209*b* and 209*c* respectively having bent leg portions of the same length similarly to those of, for example, FIG. 11 and joined integral at least at their one leg ends with the glass-made central lamp base 201 so as to communicate their interior with the cell 205 through openings 209*a'*, 209*b'* and 209*c'* made in the periphery of the base 21 substantially at regular intervals, while axial ends of the respective leg portions are closed. Electrodes 212*a*, 212*b* and 212*c* of opposite polarity to the common electrode 208 are gas-tightly secured to the other ends of the lamp tubes 209*a* to 209*c*, so that such lighting control means as in FIG. 3 can establish discharge paths sequentially between the common electrode 208 and the respective electrodes 212*a* to 212*c* and emitted light of the fluorescent lamp assembly can be freely varied in the color according to coloring fluorescent substances 211 on the inner surface of the respective lamp tubes.

In the present embodiment, the joining of the lamp tubes 209*a* through 209*c* to the base 201 as well as the securing of the respective electrodes 208 and 201*a* through 201*c* to the cell and lamp tubes can be realized all by the heating with a burner, and the fluorescent lamp assembly can be made remarkably compact. Further, it is advantageous to arrange the lamp tubes 209*a* to 209*c* so that their leg portions will be disposed on an imaginary circle as in FIG. 13, so as to prevent any irregularity in the emitted light color, while, further, the cell 205 is shown to project out of the respective ends of the lamp tubes, it may be possible to provide the cell 205 to be completely enclosed by the lamp tubes so as not to project out of their leg ends.

Referring to FIG. 19, a fluorescent lamp assembly 300 shown in which comprises a main U-shaped lamp tube 309*a* having leg portions of different lengths, longer one of which carrying at its end a common electrode 308 gas-tightly secured thereto to close the end and shorter one of which carrying an electrode 312*a* of opposite polarity to the common electrode 308 and also gas-tightly secured thereto to close the end, a pair of subsidiary U-shaped lamp tubes 309*b* and 309*c* respectively having leg portions of the same length and integrally joined at a position adjacent one leg end to the longer leg portion of the main lamp tube 309*a* in parallel thereto through communication part 309*b*' or 309*c*' positioned axially inward from the position of the common electrode 308, while electrodes 312*b* and 312*c* also of the opposite polarity to the common electrode 308 are gas-tightly secured respectively to the other leg end of each of the subsidiary lamp tubes 309*b* and 309*c* disposed on the same side with the shorter leg end of the main lamp tube 309*a*. In the present embodiment, the longer leg portion of the main lamp tube 309*a* carrying the common electrode 308 is forming a gas-tight cell 305, at a part of the leg portion extending from the position of the communication parts 309*b*' and 309*c*' to the electrode-carrying closed end, and the respective tubes can be joined as melted together by the heating as in the embodiment of FIG. 18 so as to perform substantially the same operation therewith.

When the lamp assembly of the embodiment of FIG. 19 is applied, for example, to a display device, a plurality of the lamp assemblies are to be housed within such a rectangular display casing 400 as shown in FIG. 20(*a*), in which event the fluorescent lamp assemblies 410*a* to 410*e* can be arranged in rows and columns as mutually linked as shown in FIG. 20(*b*) within the display casing.

The present invention may be subjected to various design modifications. For example, red, green and blue colors have been referred to for the coloring fluorescent substances in the respective embodiments, but any substances of other colors may be employed and one or more of the lamp tubes may be coated with white fluorescent substance for ordinary daylight illumination, in which event the color temperature can be made selectively variable as will be readily appreciated by any skilled in the art. While three of the lamp tubes have been employed in each of the embodiments, further, the number of such tubes may be increased or decreased as required. The U-shaped lamp tubes have been exemplified in contrast to the linear lamp tubes, but any lamp tube of other shapes such as a zigzag tube may be employed. In addition, the inner surfaces of the gas-tight cell, that is, the inner surfaces of the stem plate, base body and the like may be provided with a light reflective film to increase the light flux.

What is claimed as our invention is:

1. A colored fluorescent lamp assembly of the type adapted to produce illumination of sequentially different colors, said assembly comprising a plurality of lamp tubes respectively filled with a discharge gas, each tube including an inner surface coated with a colored fluorescent substance, the coating of each said inner surface producing a different color than the coatings of the other said inner surfaces, said lamp tubes each being closed at one end thereof in a gas-tight manner provided at said closed end with a first electrode of a first polarity in gas-tight manner, a cell defining a gas-tight sealed space having therein a second electrode of a second polarity opposite to said first polarity and acting as a common electrode for said first electrodes, said cell being coupled in a gas-tight manner to the other ends of the lamp tubes to communicate said sealed space with the interiors of all of the lamp tubes and having a dimension in a direction parallel to longitudinal axes of the tubes which is smaller than an axial length of said tubes, said cell including an inner surface, said coatings of fluorescent substances terminating short of said inner surface of said cell so that said inner surface of said cell is free of fluorescent substances, and a single means for controllably generating discharge lightings between said common electrode and each of said first electrodes.

2. A fluorescent lamp assembly according to claim 1, wherein said lamp tubes are of a linear shape.

3. A fluorescent lamp assembly according to claim 1, wherein said lamp tubes are U-shaped.

4. A fluorescent lamp assembly according to claim 3, wherein said cell is formed by a lamp base comprising a stem plate and a base body, and the said other ends of said lamp tubes are open ends of one bent leg portion of said U-shaped lamp tubes and coupled to said base body.

5. A fluorescent lamp assembly according to claim 4, wherein said open ends of said U-shaped lamp tubes are coupled to said base body secured to said stem plate, and said common electrode is secured to the stem plate.

6. A fluorescent lamp assembly according to claim 5, wherein said bent leg portions of said U-shaped lamp tubes have different lengths, shorter ones of which being coupled to said base body and longer ones of which being coupled to said stem plate, and the stem plate is made of a material high in the heat conductivity.

7. A fluorescent lamp assembly according to claim 4, wherein said bent leg portions of said U-shaped lamp tubes are of the same length and coupled at their all ends to one surface of said stem plate to the other surface of which said base body is secured, and said common electrode is secured to the base body.

8. A fluorescent lamp assembly according to claim 4, wherein said leg portions of said U-shaped lamp tubes are respectively disposed to be on an imaginary circle on said lamp base.

9. A fluorescent lamp assembly according to claim 7, wherein said base body is trianglar in horizontal section.

10. A fluorescent lamp assembly according to claim 1, which further comprises an auxiliary electrode of said first polarity and provided within said cell along with said common electrode.

11. A fluorescent lamp assembly according to claim 4, wherein said stem plate is provided with an exhaust pipe erected on one side of the stem plate on which side said lamp tubes are coupled thereto.

12. A fluorescent lamp assembly according to claim 3, wherein said U-shaped lamp tubes respectively have leg portions of the same length, said cell comprises a barrel-shaped lamp base disposed to be in the center of the lamp tubes as thereby surrounded, and the said other ends of the lamp tubes are coupled to said lamp base.

13. A fluorescent lamp assembly according to claim 3, wherein a first one of said U-shaped lamp tubes has bent leg portions of different lengths while the other U-shaped lamp tubes have respectively leg portions of the same length, a longer one of said different-length leg portions of said first lamp tube forming said cell at an end part of said longer leg portion, and the said other lamp tubes are coupled respectively at one of said same-length leg portions to the longer leg portion of the first lamp tube through a communication part positioned to be axially inward of the common electrode in the longer leg portion.

14. A fluorescent lamp assembly according to claim 3, wherein there are three said U-shaped lamp tubes.

15. A fluorescent lamp assembly according to claim 1 including circuit means for operably connecting a power source to said generating means, said common electrode, and said first electrodes for sequentially creating discharge lightings in said tubes.

* * * * *